US009050237B2

(12) United States Patent
Nakashima et al.

(10) Patent No.: US 9,050,237 B2
(45) Date of Patent: Jun. 9, 2015

(54) WALKING ASSIST DEVICE

(75) Inventors: Issei Nakashima, Toyota (JP); Shuhei Manabe, Miyoshi (JP)

(73) Assignee: TOYOTA JIDOSHA KABUSHIKI KAISHA, Toyota-Shi (JP)

( * ) Notice: Subject to any disclaimer, the term of this patent is extended or adjusted under 35 U.S.C. 154(b) by 803 days.

(21) Appl. No.: 13/242,688

(22) Filed: Sep. 23, 2011

(65) Prior Publication Data

US 2012/0016278 A1 Jan. 19, 2012

Related U.S. Application Data

(63) Continuation of application No. PCT/JP2009/068827, filed on Nov. 4, 2009.

(51) Int. Cl.
*A61H 3/00* (2006.01)
*A61H 1/02* (2006.01)

(52) U.S. Cl.
CPC ..... *A61H 3/00* (2013.01); *A61H 1/024* (2013.01); *A61H 2201/0176* (2013.01); *A61H 2201/1215* (2013.01); *A61H 2201/1276* (2013.01); *A61H 2201/165* (2013.01); *A61H 2201/5069* (2013.01); *A61H 2201/5079* (2013.01); *A61H 2205/102* (2013.01)

(58) Field of Classification Search
CPC ..... A61H 1/02; A61H 3/00; A61H 1/0237; A61H 1/0259; A61H 1/0262; A61H 2003/00; A61F 5/00; A61F 5/05
USPC ..... 601/5, 33–35
See application file for complete search history.

(56) References Cited

U.S. PATENT DOCUMENTS 6,969,365 B2 * 11/2005 Scorvo ..... 602/16
7,857,774 B2 * 12/2010 Sankai ..... 601/5
8,147,436 B2 * 4/2012 Agrawal et al. ..... 602/16
8,690,802 B2 * 4/2014 Sankai ..... 601/35

(Continued)

FOREIGN PATENT DOCUMENTS

JP 7-163607 A 6/1996
JP 2000-107213 A 4/2000

(Continued)

OTHER PUBLICATIONS

Translation of Written Opinion of International Searching Authority of PCT/JP2009/068827.

(Continued)

*Primary Examiner* — Justine Yu
*Assistant Examiner* — Christopher Miller
(74) *Attorney, Agent, or Firm* — Kenyon & Kenyon LLP

(57) ABSTRACT

A walking assist device which assists walking motion of one of the legs of the human with a sensor attached only to the one leg is provided. The walking assist device having an actuator, a sensor, and a controller. The sensor detects a knee joint angle and a hip joint angle of the one leg. The controller stores a first target trajectory for the knee joint angle and a second target trajectory for the hip joint angle. The controller controls the actuator so that the detected knee joint angle follows the first target trajectory. Further, the controller compares time series data of the detected hip joint angle with the second target trajectory while the one leg is in a stance phase. The controller calculates a time difference between the time series data and the second target trajectory and modifies the first target trajectory based on the time difference.

2 Claims, 7 Drawing Sheets

(56) References Cited

U.S. PATENT DOCUMENTS

| | | | | |
|---|---|---|---|---|
| 2004/0158175 | A1* | 8/2004 | Ikeuchi et al. | 601/5 |
| 2004/0249316 | A1* | 12/2004 | Ashihara et al. | 600/595 |
| 2005/0177080 | A1* | 8/2005 | Yasuhara et al. | 602/16 |
| 2006/0211956 | A1* | 9/2006 | Sankai | 601/5 |
| 2006/0276728 | A1 | 12/2006 | Ashihara et al. | |
| 2007/0054777 | A1 | 3/2007 | Kawai et al. | |
| 2008/0139968 | A1 | 6/2008 | Endo et al. | |
| 2008/0161937 | A1* | 7/2008 | Sankai | 623/25 |
| 2008/0188907 | A1* | 8/2008 | Aguirre-Ollinger et al. | 607/48 |
| 2008/0234608 | A1* | 9/2008 | Sankai | 601/5 |
| 2009/0062884 | A1* | 3/2009 | Endo et al. | 607/49 |
| 2009/0131839 | A1* | 5/2009 | Yasuhara | 601/5 |
| 2009/0192414 | A1* | 7/2009 | Yasuhara | 600/587 |
| 2009/0227424 | A1* | 9/2009 | Hirata et al. | 482/7 |
| 2009/0270766 | A1 | 10/2009 | Yasuhara | |
| 2009/0319054 | A1* | 12/2009 | Sankai | 623/25 |
| 2010/0271051 | A1 | 10/2010 | Sankai et al. | |
| 2012/0226203 | A1 | 9/2012 | Nakashima et al. | |

FOREIGN PATENT DOCUMENTS

| | | | |
|---|---|---|---|
| JP | 2004-261622 | A | 9/2004 |
| JP | 2004-329520 | A | 11/2004 |
| JP | 2005-000500 | A | 1/2005 |
| JP | 2005-211086 | A | 8/2005 |
| JP | 2006-167223 | A | 6/2006 |
| JP | 2006-314670 | A | 11/2006 |
| JP | 2007-061527 | A | 3/2007 |
| JP | 2007-275482 | A | 10/2007 |
| JP | 2008-068046 | A | 3/2008 |
| JP | 2009-254740 | A | 11/2009 |
| JP | 2010-148637 | A | 7/2010 |
| WO | 2009/084387 | A1 | 7/2009 |

OTHER PUBLICATIONS

International Search Report of PCT/JP2009/068827 mailed Dec. 28, 2009.

Office Action mailed on Nov. 5, 2014, in U.S. Appl. No. 13/509,449.

* cited by examiner

WALKING ASSIST DEVICE

CROSS-REFERENCE TO RELATED APPLICATIONS

This application is a Continuation of International Application No. PCT/JP2009/068827 filed on Nov. 4, 2009, the disclosure of which is hereby incorporated by reference herein in its entirety.

TECHNICAL FIELD

Disclosed herein is a walking assist device which assists walking motion of a human.

BACKGROUND ART

A walking assist device which assists walking motion of a human by applying torques to the knee joint of the human is being developed. For example, the patent document 1 (Japanese Patent Application Publication No. 2006-314670) discloses the walking assist device suitable for the user who is not able to move one of the legs properly. In this description, a leg which the user can entirely control is referred to as a "sound leg" and a leg which the user can not properly control at least one joint is referred to as an "affected leg" hereafter. Further, a part of the leg between the knee and the ankle is referred to as a "lower leg" and a part of the leg between the hip joint and the knee is referred to as an "upper leg". The walking assist device in the patent document 1 measures a motion pattern of the sound leg by a sensor and applies torque on the joint of the affected leg so that the motion pattern of the affected leg follows the motion pattern of the sound leg.

SUMMARY OF INVENTION

If the leg motion pattern which the user expects to follow and the leg motion pattern induced by the walking assist device are not matched, the walking assist device may give the user an awkward feeling. If sensors can be attached on the sound leg as shown in the patent document 1, the motion pattern of the sound leg can be measured. It is thereby possible to realize an assist in the walking motion, without giving the user the awkward feeling, by applying torque to the joint of the affected leg so that the motion pattern of the affected leg follows the pattern of the sound leg. However, it may be burdensome for the user to attach sensors on the sound leg. The teachings herein provides a walking assist device which assists the walking motion by applying torque to one of the legs of the user based on the output of a sensor attached only to the one leg. The walking assist device can assist the walking motion of the one leg of the user without giving the user the significant awkward feeling. Teachings disclosed by the present description may especially be suitable for the walking assist device for the user having one affected leg. The walking assist device is able to appropriately assist the motion of the affected leg with no sensors on the sound leg.

If the pattern of the torque applied by the walking assist device does not match with the motion pattern which the user expects, it may give the user an uncomfortable feeling. According to the researches by the inventors, it is found that following timings in a gait cycle especially give the user uncomfortable feelings: (1) a timing at which the lower leg starts swinging (rotating) backward in a latter half of a stance phase; (2) a timing at which a swing direction of the lower leg changes from forward to backward at the middle of a swing phase; and (3) a landing timing of a swing leg. The reason is that the torque applied by the walking assist device significantly changes at those timings. If the walking assist device applies the torque at a timing as close as possible to the timing which the user expects for at least one of those timings, the device may give the user less uncomfortable feeling. In the present description, the "stance phase" of a leg means a period in which the leg is grounding and the "swing phase" of a leg means a period in which the leg is not grounding in a gait cycle. Further, the timing at which the lower leg starts swinging (rotating) backward in the latter half of the stance phase is referred to as a "pre-swing timing" and the timing at which the swing direction of the lower leg changes from forward to backward in the middle of the swing phase is referred to as a "maximum knee angle timing".

One preferred embodiment for the walking assist device provided by the teachings of the present description comprises an actuator, an angle sensor and a controller. The actuator is able to apply torque to the knee joint of one of the legs. The angle sensor detects the knee joint angle and the joint angle of the hip joint of the one leg around the pitch axis. Hereinafter, the joint angle of the hip joint of the one leg around the pitch axis is simply referred to as a "hip joint angle". The controller stores a target trajectory for the knee joint angle of the one leg and a target trajectory for the hip joint angle of the one leg. Those target trajectories represent time dependent changes of the knee joint angle and hip joint angle in walking motion. That is, the target trajectories are substantially equivalent to the motion pattern of the leg. The controller controls the actuator so that the detected knee joint angle follows the stored target trajectory for the knee joint angle. Further, the controller compares time series data of the detected hip joint angle with the stored target trajectory for the hip joint angle during the one leg is in stance phase. Then, the controller calculates a time difference between the time series data of the hip joint angle and the target trajectory for the hip joint angle. Finally, the controller modifies the target trajectory for the knee joint angle based on the calculated time difference.

Hereinafter, the one of the legs of the user is referred to as a "first leg" and the other of the legs is referred to as a "second leg" for simplifying the following explanation.

The walking assist device estimates the timing that the user expects, from the hip joint angle of the first leg while the first leg is in the stance phase. Then the walking assist device modifies the target trajectory for the knee joint angle of the first leg. That is, the walking assist device modifies the target trajectory for the knee joint angle of the first leg without any information regarding the second leg. Therefore, the walking assist device does not require attaching any sensors to the second leg.

Further, the walking assist device is able to relatively precisely estimate the timings which the user expects by using the hip joint angle in the stance phase. This is because the hip joint angle significantly changes when the lower leg starts swinging (rotating) backward in the latter half of the stance phase. Therefore, the walking assist device can precisely compare the time series data of the detected hip joint angle with the stored target trajectory for the hip joint angle. The time difference between the time series data of the hip joint angle and the stored target trajectory for the hip joint angle corresponds to the gap between the timing which the user expects and the timing in the target trajectory. By shifting the target trajectory by the time difference, the modified target trajectory comes closer to the motion pattern which the user expects. (As previously mentioned, the target trajectory is substantially equivalent to the motion pattern of the first leg.) The walking assist device controls the actuator so that the detected knee joint angle follows the modified target trajectory for the knee joint. By modifying the target trajectory for the knee joint angle, the time series pattern of the torque which the actuator applies comes closer to the corresponding walking pattern which the user expects and thus, the walking assist device gives less uncomfortable feeling to the user.

The mechanism which applies torque to the user's knee joint may typically be a wearable device having an upper link which is to be fixed to the upper leg, a lower link which is to be fixed to the lower leg, and a mechanical joint which connects the two links. In the present description, a device to be attached to the leg may be referred to as a "leg attachment". The mechanical joint is provided with a motor which swings the lower link. When the leg attachment is attached to the user's first leg, the mechanical joint is located substantially coaxially with the axis of the user's knee joint. Hereinafter, the target trajectory for the knee joint angle of the one leg is referred to as a "first target trajectory" and the target trajectory for the hip joint angle of the one leg is referred to as a "second target trajectory".

According to the preferred embodiment of the present disclosure, the aforementioned time difference is a gap between the reverse timing in the time series of the detected hip joint angle and the reverse timing in the second target trajectory. Here, the term "the reverse timing" means a timing at which the swing direction of the upper leg changes from backward to forward. The reason is that the time dependent variation of the hip joint angle becomes significant at the reverse timing at which the swing direction reverses and thus, the reverse timing is suitable as an index for comparing the time series data of the detected hip joint angle with the second target trajectory. Further, the reverse timing corresponds to the pre-swing timing at which the lower leg starts swinging (rotating) backward in stance phase. Therefore, by modifying the first target trajectory at that timing, the walking assist device starts applying torque along the direction swinging the lower leg backward. That is, the walking assist device is able to start applying torque at a timing similar to the pre-swing timing which the user expects.

According to another preferred embodiment of the present description, the modification of the first target trajectory may shift a predetermined landing timing in the first trajectory by the calculated time difference. Alternatively, according to yet another preferred embodiment, the modification of the first target trajectory may compress a time span of a latter half of the swing phase in the first target trajectory by the calculated time difference. According to the either preferred embodiments, the predetermined landing timing in the first target trajectory after modification comes closer to the landing timing which the user expects. Therefore, the time dependent variation of the torque applied based on the modified target trajectory may induce the motion pattern closest to the motion pattern imaged by the user and thus, the user's uncomfortable feeling may be lessened. Preferably, "the latter half of the swing phase" may be defined from the timing at which the knee joint maximally flexed to the landing timing.

DESCRIPTION OF EMBODIMENTS

Representative, non-limiting examples of the present invention will now be described in further detail with reference to the attached drawings. This detailed description is merely intended to teach a person of skill in the art further details for practicing preferred aspects of the present teachings and is not intended to limit the scope of the invention. Furthermore, each of the additional features and teachings disclosed below may be utilized separately or in conjunction with other features and teachings to provide an improved walking assist device.

Figure 1A:
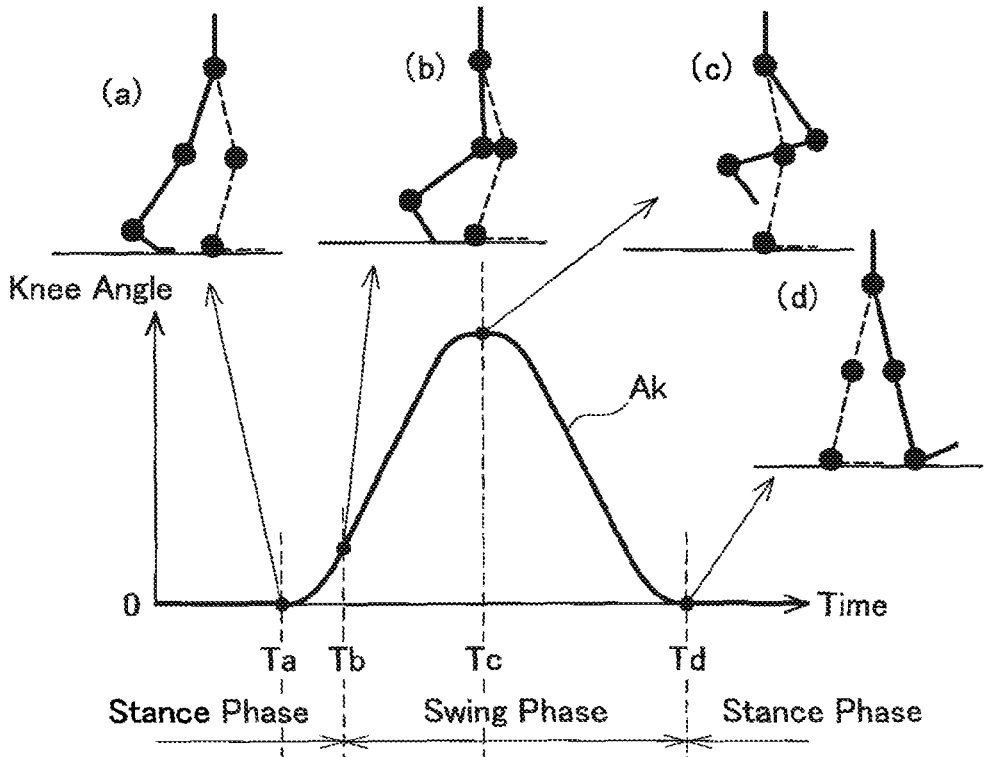
FIG. 1A shows a time variation of a knee angle and leg motion upon walking.
Figure 1B:
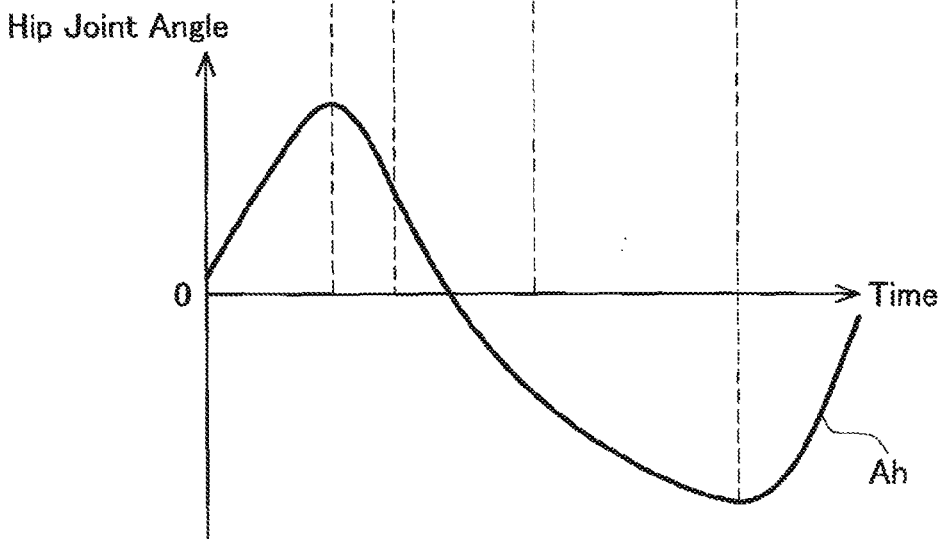
FIG. 1B shows a time variation of a hip angle upon walking.

In advance to starting the explanation of a preferred embodiment of the present teachings, the leg motion upon walking will be explained. FIGS. 1A and 1B show a motion of a first leg upon walking. The graph denoted by symbol Ak represents the time variation of the knee joint angle (knee angle) of the first leg. The graph denoted by symbol Ah represents the time variation of the hip joint angle of the first leg. Here, the term "hip joint angle" means an angle around the pitch axis. Although the scope of the teachings disclosed herein is not limited to this, in the explanation of the present description, the first leg corresponds to the right leg of the user and the second leg corresponds to the left leg of the user. Further, it should be noted that the graphs in FIGS. 1A, 1B represents an outline (a trend) of the time variations for each parameters, not represent precise time variations. Also, it should be noted that a part of the stance phase is abbreviated in FIG. 1.

Figure 2:
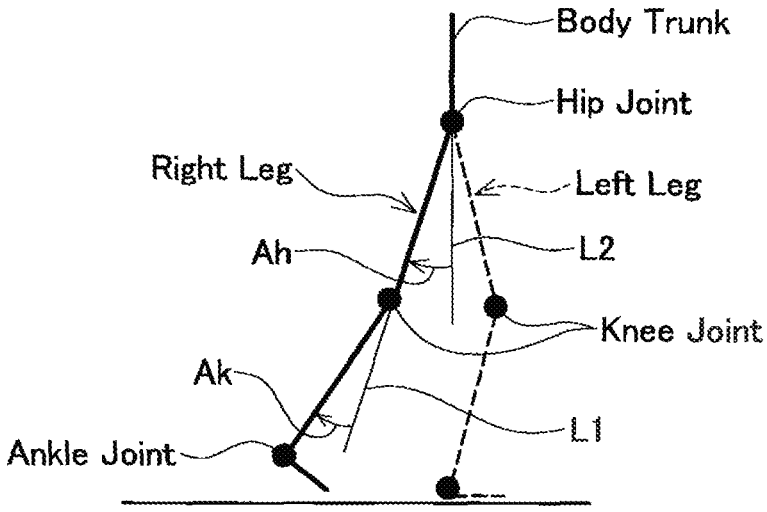
FIG. 2 shows an explanation of parameters used in FIGS. 1A, 1B.

FIG. 2 gives an explanation for the definition of the knee angle Ak and the hip angle Ah. In FIG. 2, the solid line denotes the first leg (right leg) and the dashed line denotes the second leg (left leg). The solid line above the hip joint represents the body trunk. The meanings of the solid and dashed lines in FIG. 1A are the same as in FIG. 2. The straight line L1 represents the line connecting the hip joint and the knee joint. The straight line L1 extends along the longitudinal direction of the upper leg. The knee angle Ak is defined as an angle measured from the straight line L1 to the lower leg. When the knee has been straightened, this corresponds to the knee angle Ak=0. When the knee has been flexed to a right angle, this corresponds to the knee angle Ak=+90. The straight line L2 represents the line extending along the body trunk with passing the rotation axis of the hip joint. The hip joint angle Ah is zero where the upper leg aligns with the straight line L2. Further, the hip joint angle Ah indicates positive value where the upper leg is positioned toward the backside than the body trunk. The hip joint angle Ah indicates negative value where the upper leg swings to foreside.

Back to FIG. 1, the explanation of the walking motion will be continued. At the timing Ta, the heel of the first leg starts lifting and the lower leg of the first leg starts swinging backward in the last portion of the stance phase. The configuration of the leg at the timing Ta is depicted in (a) in FIG. 1. As the solid line (the first leg) in (a) indicates, at the timing Ta, the lower leg starts swinging (rotating) backward while the toe remains grounding. That is, the knee angle starts increasing at the timing Ta. On the other hand, the time variation of the hip joint angle reverses from increase to decrease at the timing Ta. It means that the swing direction of the upper leg changes from backward to forward at the timing Ta. In other words, the first leg is swung most backward at the timing Ta, and the first leg swings forward after the timing Ta.

The first leg lifts at the timing Tb. The configuration of the leg at the timing Tb is depicted in (b) in FIG. 1. During the period from the timing Ta to the timing Tb, the knee angle of the first leg changes while the foot of the first leg is grounding. This period is called as "a pre-swing period". It is clear from FIG. 1, the lower leg starts swinging backward at the timing Ta. In other words, the timing at which the lower leg starts swinging backward in the stance phase corresponds to the beginning of the pre-swing period. The timing Ta at which the lower leg starts swinging backward is referred to as a "pre-swing timing Ta" hereinafter.

The knee angle Ak reaches maximum at the timing Tc. The timing Tc is referred to as a "maximum knee angle timing". The configuration of the leg at the timing Tc is depicted in (c) in FIG. 1. The first leg lands at the timing Td. The configuration of the leg at the timing Td is depicted in (d) in FIG. 1.

The period from the timing Tb to the timing Td corresponds to the swing phase of the first leg. The period before the timing Tb and after the timing Td corresponds to the stance phase of the first leg. It is noted that a part of the stance phase is abbreviated in FIG. 1. The period from the timing Ta to the timing Tb corresponds to the pre-swing period as mentioned before.

The hip joint angle Ah of the first leg has the local maximum at the pre-swing timing Ta. At the pre-swing timing Ta, the upper leg is swung most backward. That is, the upper leg swings backward before the pre-swing timing Ta and swings forward after the pre-swing timing Ta. In other words, the swing direction of the upper leg changes from backward to forward at the pre-swing timing Ta. The pre-swing timing Ta may be referred to as a "reverse timing".

The hip joint angle Ah reaches zero around the lifting timing Tb, and has the local minimum at the landing timing Td. It is noted that the negative value of the hip joint angle Ah means that the upper leg positions in front of the body trunk. The upper leg is swung most forward at the landing timing Td.

The walking assist device which assists walking motion of the human by applying torque to the knee joint will be described. The walking assist device employs the time variation pattern of the knee angle Ak in FIG. 1 as a target trajectory (first target trajectory) in the swing phase and applies the torque so that the knee angle of the user follows the first target trajectory. As understood from the graph of the first target trajectory of the knee angle, The walking assist device starts applying torque in the direction along which the lower leg is swung backward at the pre-swing timing Ta, the device changes the direction of the torque at the maximum knee angle timing Tc, and the device terminates applying the torque in the direction along which the lower leg is swung forward. As can be seen, the applied torque varies significantly at each of the above three timings. Preferably, the walking assist device applies torque at a timing that is as close as possible to the corresponding timing of the walking motion which the user expects for at least one of those timings. Preferred embodiments for such a walking assist device will be described hereafter.

Figure 3A:
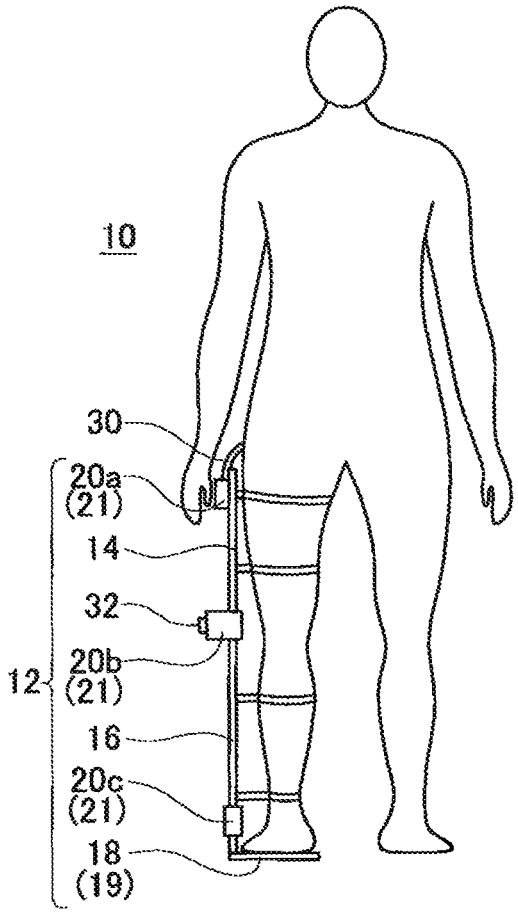
FIG. 3A is a schematic front view of the walking assist device according to the embodiment.
Figure 3B:
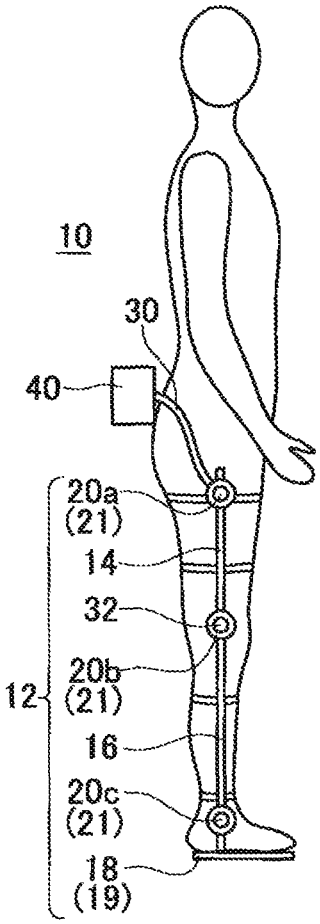
FIG. 3B is a schematic side view of the walking assist device according to the embodiment.

FIG. 3A shows a schematic front view of the walking assist device 10 and FIG. 3B shows a schematic side view of the walking assist device 10 of the embodiment. The walking assist device 10 is provided with a leg attachment 12 and a controller 40. The leg attachment 12 is to be attached to the user's right leg (the first leg). The walking assist device according to the embodiment is suitable for the user who cannot properly control the knee joint of the right leg.

The mechanical configuration of the leg attachment 12 will be explained. The leg attachment 12 is to be attached outside the right leg of the user from the upper leg to the lower leg. The leg attachment 12 has the multi-link mechanism comprising an upper link 14, a lower link 16 and a foot link 18. The upper end of the upper link 14 is rotatably connected to the waist link 30 via a first joint 20*a*. The upper end of the lower link 16 is rotatably connected to the lower end of the upper link 14 by the second joint 20*b*. The foot link 18 is rotatably connected to the lower end of the lower link 16 by the third joint 20*c*. The upper link 14 is to be fixed to the upper leg of the user by a belt. The lower link 16 is to be fixed to the lower leg of the user by a belt. The foot link 18 is to be fixed to the sole of the user by a belt. The belt which ties the foot link 18 is abbreviated in the figures. The waist link 30 is to be fixed to the user's body trunk (waist).

When the user wears the leg attachment 12, the first joint 20*a*, the second joint 20*b* and the third joint 20*c* are located coaxially with the pitch axis of the right hip joint, the pitch axis of the knee joint, and the pitch axis of the ankle joint of the user respectively. Each link of the leg attachment 12 is able to swing in response to the motion of the first leg (right leg) of the user. Each joint has an encoder 21 which detects an angle between adjacent two links connected with the joint. The angle between the two links corresponds to the joint angle. In other words, the encoder 21 detects the angle of each joint. The encoder 21 at the first joint 20*a* detects the angle of the right hip joint around the pitch axis. The encoder 21 at the second joint 20*b* detects the angle of the right knee joint around the pitch axis. The encoder 21 at the third joint 20*c* detects the angle of the right ankle joint around the pitch axis. The encoders 21 attached to the joints may collectively be referred to as "the angle sensor 21".

Ground sensors 19 are attached to the foot link 18. The ground sensors 19 are provided at two positions: front and rear of the sole of the foot link 18. The ground sensors 19 detect whether the first leg is in contact with the ground or not.

A motor 32 (actuator) is provided to the second joint 20*b*. The motor 32 is located outside the knee joint of the user. The motor 32 is located substantially coaxially with the knee joint of the user. The motor 32 is able to swing the lower link 16 relative to the upper link 14. In other words, the motor 32 is able to apply torque to the right joint of the user.

The walking assist device 10 assists the walking motion by applying torque to the user's right knee joint (the first leg knee joint) by the motor 32 on the leg attachment 12 in response to the user's walking motion.

The control processes performed by the walking assist device 10 will be described. The control processes are performed by the controller 40. The controller 40 stores the target trajectory for the knee joint angle (knee angle) and the target trajectory for the hip joint angle. Hereinbelow, the target trajectory for the knee joint angle is referred to as the first target trajectory and the target trajectory for the hip joint angle is referred to as the second target trajectory. The first target trajectory (the target trajectory for the knee angle) corresponds to the time series data of the knee angle Ak in FIG. 1. The second target trajectory (the target trajectory for the hip joint angle) corresponds to the time series data of the hip joint angle Ah in FIG. 1. It is noted that the second target trajectory is used as a reference for modifying the first target trajectory, and the walking assist device 10 of the present embodiment does not apply torque to the hip joint of the user.

The controller 40 controls the motor 32 so basically that the knee angle detected by the sensor follows the stored first target trajectory (the target trajectory for the knee joint angle). As described in detail below, the controller 40 modifies the first target trajectory based on the time difference between the time series data of the detected hip joint angle and the stored second target trajectory (the target trajectory for the hip joint angle Ah) and controls the motor 32 based on the modified target trajectory. Hereinafter, the detected hip angle is denoted by the symbol sAh and the detected knee angle is denoted by the symbol sAk.

Figure 4:
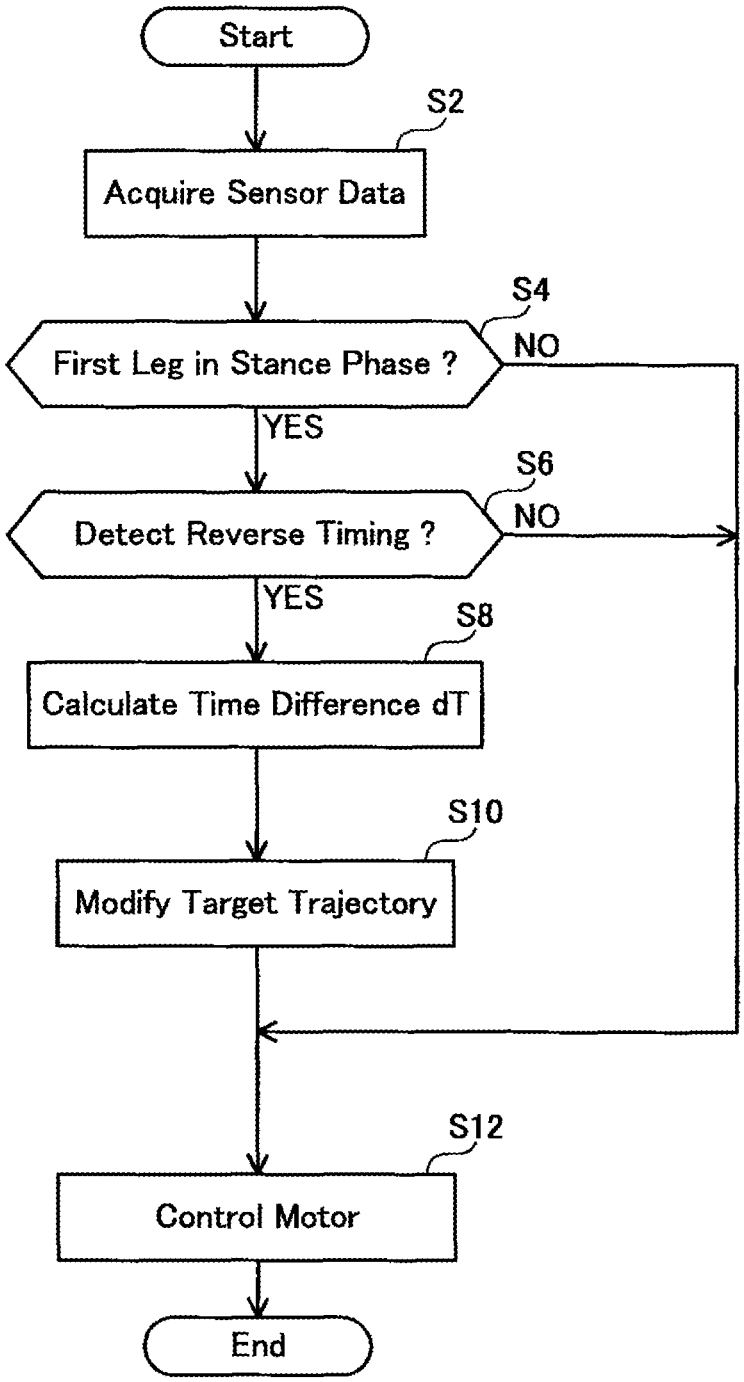
FIG. 4 is a flowchart of the processes which the walking assist device performs according to the embodiment.

FIG. 4 shows the flow chart of the processes performed by the controller 40. The processes of the FIG. 4 are repeatedly performed in every control cycle. The controller 40 acquires the sensor data from the angle sensor 21 and the ground sensors 19 (S2). Next, the controller 40 judges whether the first leg is in the stance phase or not based on the sensor data of the ground sensors 19 (S4). The situation where the first leg is not in the stance phase means the situation where the first leg is in the swing phase. When the controller 40 judges that the first leg is in the swing phase (S4: NO), the controller 40 continues the following control using the first target trajectory (S12). That is, the controller 40 controls the motor 32 so that the detected knee angle sAk follows the knee angle Ak described in the first target trajectory.

If the controller 40 judges that the first leg is in the stance phase, the controller 40 detects the reverse timing from the detected hip joint angle sAh (S6). As explained before, the reverse timing means a timing at which the hip joint angle changes from increase to decrease. The controller 40 determines the current timing as the reverse timing when the hip joint angle sAh(N) detected at the current control cycle N is smaller than the hip joint angle sAh(N−1) at the previous control cycle N−1.

If the hip joint angle sAh(N) detected at the current control cycle N does not correspond to the reverse timing, the controller 40 continues the following control with the stored first target trajectory (S6:NO, S12). On the other hand, if the current timing is determined as the reverse timing, the controller 40 compares the time series data of the detected hip joint angle sAh with the stored second target trajectory (the target trajectory for the hip joint angle Ah), and calculates the time difference dT (S8). Specifically, the controller 40 has stored the reverse timing defined on the second target trajectory and calculates the time difference dT between the stored reverse timing and the reverse timing detected at step S6. Next, the controller 40 modifies the stored first target trajectory (the target trajectory for the knee joint angle) based on the time difference dT. Specifically, the controller 40 shifts the stored first target trajectory by the time difference dT. Then the controller 40 controls the motor so that the knee angle follows the modified first target trajectory (S12).

Figure 5A:
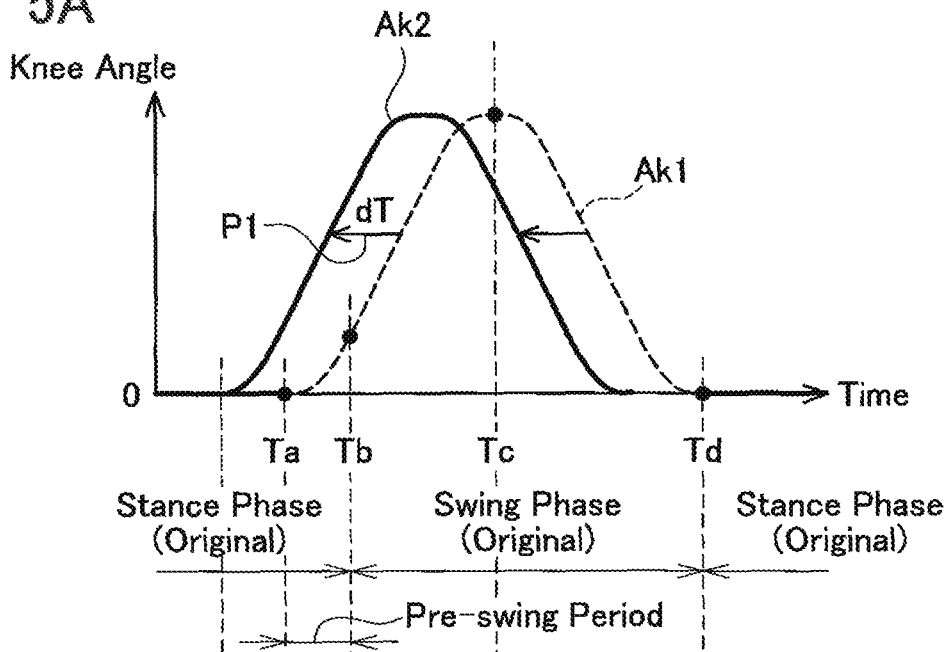
FIG. 5A shows one example for modifying for a knee angle trajectory.
Figure 5B:
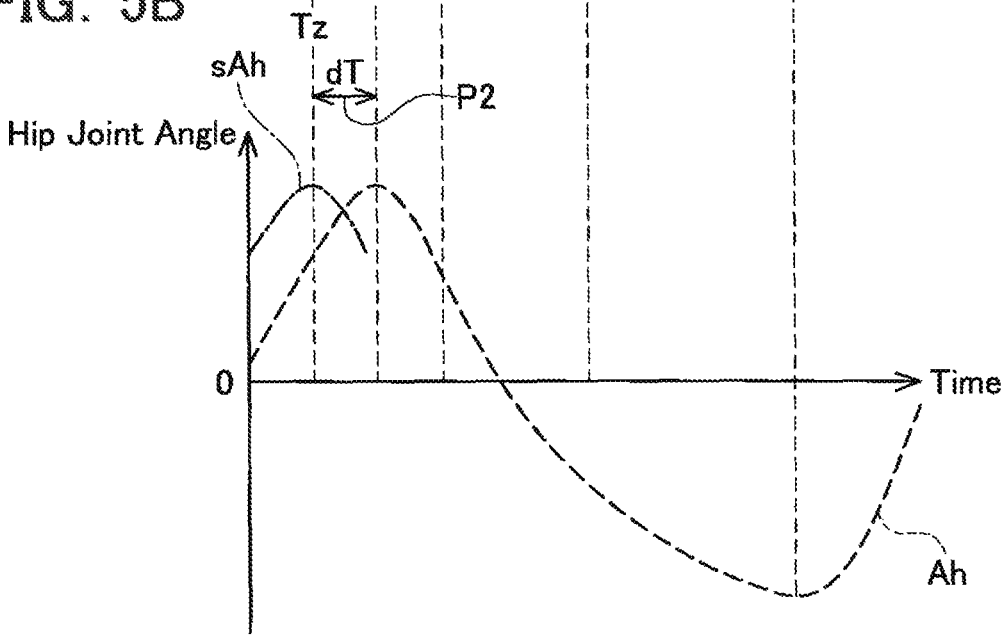
FIG. 5B shows a hip joint angle trajectory.

Next, one example for modifying the first target trajectory will be explained. FIGS. 5A, 5B shows an example of a target modification process. The dashed line Ak1 in FIG. 5A denotes the first target trajectory (the knee angle target trajectory) before modification. The dashed line Ah in FIG. 5B denotes the second target trajectory (the hip joint angle target trajectory) corresponds to the first target trajectory before modification. The controller 40 stores the first target trajectory Ak1 and the second target trajectory Ah. Further, the controller 40 stores the reverse timing Ta (the pre-swing timing Ta) determined on the stored first target trajectory Ak1.

The dash-dotted line sAh in FIG. 5B denotes the detected hip joint angle. Now, it is assumed that the reverse timing detected at step S6 corresponds to the timing Tz in FIG. 5. The current time is assumed to be just after the timing Tz. That is, the right end of the dashed-dotted line sAh where it terminates corresponds to the current time. At step S8, the controller 40 calculates the time difference dT between the reverse timing Tz detected at step S6 and the determined reverse timing Ta. The arrowed line denoted by symbol P2 in FIG. 5B represents this calculation process. Next, the controller 40 shifts the first target trajectory Ak1 by the time difference dT. The arrowed line denoted by symbol P1 in FIG. 5A represents the shifting process. As a result, the graph denoted by symbol Ak2 in FIG. 5A is derived as the modified first target trajectory.

At step S12, the controller 40 controls the motor based on the modified first target trajectory Ak2. By modifying the first target trajectory, the target angle for the knee joint at the current time changes. The positive value of the knee angle means the swing of the lower leg backward. By modifying the first target trajectory, the target angle of the knee joint increases and, as a consequence, torque which swings the lower leg backward is applied. In reality, because the control cycle time is a few milliseconds, the reverse timing Tz is detected just at the timing Tz. Therefore, the controller 40 starts applying torque which swings the lower leg backward at the time at which the reverse timing Tz (the pre-swing timing Tz) is detected.

Further, the maximum knee angle timing Tc and the predicted landing timing before modification are shifted by the time difference dT in the modified first target trajectory Ak2. The modified maximum knee angle timing and predicted landing timing correspond to the detected reverse timing Tz. Because the modified first target trajectory Ak2 corresponds to the detected reverse timing Tz, thus, the modified first target trajectory Ak2 meets the knee motion pattern which the user expects. Therefore, the torque pattern applied by the walking assist device 10 based on the modified first target trajectory may give the user less uncomfortable feeling.

The walking assists device 10 according to the embodiment supports the walking motion with applying the torque to the knee joint of the first leg of the user based on the sensor data of the first leg. Further, the torque pattern applied by the walking assist device 10 give the user less uncomfortable feeling. In this example, the detected hip joint angle sAh has reached its local maximum at timing Tz, which is earlier than a timing at which the hip joint angle is supposed to reach the local maximum in the stored second target trajectory Ah. The first target trajectory Ak1 is modified by having its scheduled timings brought forward in time by the amount of the time difference dT. Entire trajectory of the modified first target trajectory Ak2 is shifted forward in time from the first target trajectory Ak1.

Figure 6:
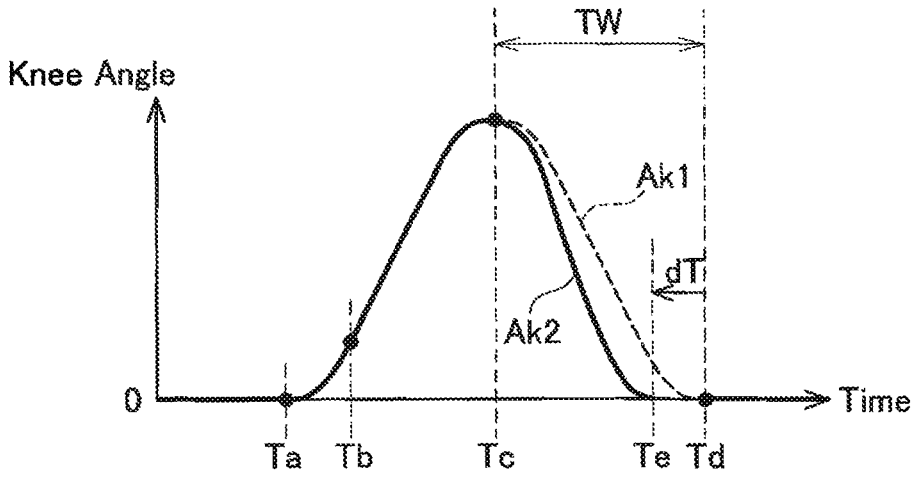
FIG. 6 shows another example for modifying the knee angle trajectory.

Another example for modifying the first target trajectory at step 10 will be explained. FIG. 6 shows another example for the target trajectory modification. The controller 40 compresses the time span Tw of the latter half of the swing phase on the first target trajectory Ak1 by the time difference dT along the time direction after calculating the time difference dT at step S8. Here, the latter half of the swing phase on the first target trajectory corresponds to the period from the maximum knee angle timing Tc to the predicted landing timing Td on the original first target trajectory Ak1. The modified first target trajectory Ak2 shifts gradually from the predetermined maximum knee angle timing Tc, and shifts the landing timing forward in time to the modified landing timing Te, which is earlier than the original expected landing timing Td by the amount the time difference dT. According to this modification, the controller of the walking assist device generates the modified first target trajectory which shifts gradually from the original first target trajectory. The user will not notice the modification of the target trajectory because the modified target trajectory changes gradually from the original target trajectory.

Combinations of features and steps disclosed in the present detail description may not be necessary to practice the invention in the broadest sense, and are instead taught merely to particularly describe representative examples of the invention. Furthermore, various features of the presently described representative examples, as well as the various independent and dependent claims, may be combined in ways that are not specifically and explicitly enumerated in order to provide additional useful embodiments of the present teachings.

All features disclosed in the description and/or the claims are intended to be disclosed separately and independently from each other for the purpose of original written disclosure, as well as for the purpose of restricting the claimed subject matter, independent of the compositions of the features in the embodiments and/or the claims. In addition, all value ranges or indications of groups of entities are intended to disclose every possible intermediate value or intermediate entity for the purpose of original written disclosure, as well as for the purpose of restricting the claimed subject matter.

The invention claimed is:

1. A walking assist device comprising:

an actuator configured to apply torque to a knee joint of one of the legs of a human;

an angle sensor that detects a knee joint angle of the one leg and a hip joint angle of the one leg around a pitch axis; and a controller that stores a first target trajectory for the knee joint angle and a second target trajectory for the hip joint angle around the pitch axis, the controller controls the actuator so that the detected knee joint angle follows the first target trajectory;

wherein, while the one leg is in a stance phase, the controller is programmed to:

compare time series data of the detected hip joint angle with the second target trajectory;

calculate a time difference which is a difference between a reverse timing in the time series and a reverse timing in the second target trajectory, the reverse timing is a timing at which a swing direction of an upper leg changes from backward to forward;

modify the first trajectory based on the calculated time difference; and wherein while modifying the first target trajectory, the controller shifts a predetermined landing timing in the first target trajectory by the calculated time difference.

2. A walking assist device comprising:

an actuator configured to apply torque to a knee joint of one of the legs of a human;

an angle sensor that detects a knee joint angle of the one leg and a hip joint angle of the one leg around a pitch axis; and a controller that stores a first target trajectory for the knee joint angle and a second target trajectory for the hip joint angle around the pitch axis, the controller controls the actuator so that the detected knee joint angle follows the first target trajectory;

wherein, while the one leg is in a stance phase, the controller is programmed to:

compare time series data of the detected hip joint angle with the second target trajectory;

calculate a time difference which is a difference between a reverse timing in the time series and a reverse timing in the second target trajectory, the reverse timing is a timing at which a swing direction of an upper leg changes from backward to forward;

modify the first trajectory based on the calculated time difference; and wherein while modifying the first target trajectory, the controller shortens a time span of a latter half of a swing phase in the first target trajectory by the calculated time difference.

* * * * *